US009243406B1

(12) United States Patent
Boguslavschi et al.

(10) Patent No.: US 9,243,406 B1
(45) Date of Patent: Jan. 26, 2016

(54) REINFORCEMENT FOR REINFORCED CONCRETE

(71) Applicant: TS-Rebar Holding LLC, Henderson, NV (US)

(72) Inventors: Nicolai Boguslavschi, Chisinau (MD); Chester Wright, III, Las Vegas, NV (US); Arkady Zalan, Henderson, NV (US)

(73) Assignee: TS—Rebar Holding, LLC, Henderson, NV (US)

( * ) Notice: Subject to any disclaimer, the term of this patent is extended or adjusted under 35 U.S.C. 154(b) by 0 days.

(21) Appl. No.: 14/601,438

(22) Filed: Jan. 21, 2015

(51) Int. Cl.
*E04C 5/03* (2006.01)

(52) U.S. Cl.
CPC ..... *E04C 5/03* (2013.01)

(58) Field of Classification Search
CPC ..... E04C 5/03; E04C 5/012; E04C 5/073; E04C 5/01; B29C 53/14; B29C 70/50; B29C 70/525; B29C 70/16
USPC ..... 52/831, 857; D25/119, 123, 125, 164
See application file for complete search history.

(56) References Cited

U.S. PATENT DOCUMENTS

| | | | | | |
|---|---|---|---|---|---|
| 542,206 | A | * | 7/1895 | Ransome | 52/857 |
| 884,341 | A | * | 4/1908 | Ramsey | 52/857 |
| 931,049 | A | * | 8/1909 | Foster et al. | 52/857 |
| 931,320 | A | * | 8/1909 | Large | 52/857 |
| 931,322 | A | * | 8/1909 | Lindau | 52/851 |
| 1,002,565 | A | * | 9/1911 | Coryell | 52/857 |
| 1,100,742 | A | * | 6/1914 | Kane | 52/852 |
| 1,111,646 | A | * | 9/1914 | Compton | 52/600 |
| 1,317,824 | A | * | 10/1919 | Royse | 52/853 |
| 1,400,278 | A | * | 12/1921 | Fougner | 52/852 |
| 1,551,863 | A | | 9/1925 | Berry | |
| 1,607,089 | A | * | 11/1926 | Leidecker | 72/64 |
| 1,980,668 | A | | 11/1934 | Davis | |
| 2,123,239 | A | * | 7/1938 | Griffel | 52/857 |
| 2,142,758 | A | * | 1/1939 | Ossoinack | E04C 5/03 52/857 |
| 2,256,060 | A | * | 9/1941 | Stites | E04C 5/03 52/857 |
| 2,260,779 | A | * | 10/1941 | Hoffmann | 72/187 |
| 2,317,454 | A | * | 4/1943 | Greulich | E04C 5/03 52/857 |
| 2,324,651 | A | * | 7/1943 | Stites | E04C 5/03 29/897.34 |
| 2,355,156 | A | * | 8/1944 | Haines | E04C 5/03 52/857 |
| 2,418,382 | A | * | 4/1947 | Wennberg et al. | 52/857 |
| 2,418,383 | A | * | 4/1947 | Wennberg et al. | 52/857 |
| 2,562,516 | A | * | 7/1951 | Williams | 470/11 |
| 3,135,341 | A | * | 6/1964 | Ritter | 175/391 |
| 3,214,877 | A | | 11/1965 | Akin | |
| 3,378,985 | A | | 4/1968 | Bugan | |
| 3,561,185 | A | * | 2/1971 | Finsterwalder et al. | 52/853 |
| 4,229,501 | A | * | 10/1980 | Kern | 428/399 |
| 4,791,772 | A | | 12/1988 | Potucek | |

(Continued)

FOREIGN PATENT DOCUMENTS

RU 2467075 C2 11/2012

*Primary Examiner* — Brent W Herring
(74) *Attorney, Agent, or Firm* — IRL Legal Services, LLC; Ilya R. Lapshin

(57) ABSTRACT

A spiral rebar weldable metal rod with a constant or variable pitch of between 1 and 10 times a diameter of a cylinder into which the rod is inscribed; with a planar cross-section having at least two petals connected to the central section and separated from each other by gaps. The triangular petals are connected with the central section by their vertices; the petal edges distant from the central section are circular. The rebar has ribs; the ribs' height is between 0.5 mm and 1.0 mm and distances between the ribs are between 5 mm and 15 mm.

10 Claims, 3 Drawing Sheets

(56) References Cited

U.S. PATENT DOCUMENTS

| | | | | | |
|---|---|---|---|---|---|
| 4,811,541 | A * | 3/1989 | Finsterwalder | 52/853 |
| 4,856,952 | A * | 8/1989 | Shaw | 411/413 |
| 4,858,457 | A * | 8/1989 | Potucek | 72/187 |
| 4,922,681 | A * | 5/1990 | Russwurm et al. | 52/853 |
| 5,950,393 | A | 9/1999 | Stecker | |
| 6,060,163 | A * | 5/2000 | Naaman | 428/397 |
| 6,264,403 | B1 * | 7/2001 | Hall et al. | 405/252.1 |
| 6,886,384 | B2 * | 5/2005 | Gray | 72/103 |
| 7,045,210 | B2 | 5/2006 | Bleibler | |
| 7,269,987 | B2 * | 9/2007 | Ollis | 72/64 |
| 8,915,046 | B2 | 12/2014 | Wright, III | |
| 2004/0035177 | A1 * | 2/2004 | Ollis | 72/371 |
| 2004/0065044 | A1 * | 4/2004 | Bleibler | 52/649.1 |
| 2009/0226251 | A1 * | 9/2009 | Ollis | 403/408.1 |

* cited by examiner

REINFORCEMENT FOR REINFORCED CONCRETE

TECHNICAL FIELD

The present disclosure relates generally to field of construction materials and, particularly, to reinforcement for concrete including precast and monolithic reinforced concrete structures.

BACKGROUND

Reinforced concrete is a popular construction material. It typically uses embedded reinforcement structures that have high tensile strength and ductility to reinforce concrete.

One popular type of reinforcement is a steel reinforcement bar (i.e, rebar). A rebar may be a hot-rolled or cold-drawn metal rod with circular cross section and ribbed surface. The ribs of various shapes enhance bonding between the rebar and concrete for joint performance under tension and flexion or bending. However, due to small height of the ribs, the bonding between the ribs and concrete can break under the stress, causing slippage of the rebar inside concrete, which weakens the concrete. To obtain the necessary tensile strength of the reinforcement, the amount of rebar must be increased, which adversely increases weight of the reinforcement and cost of construction of the reinforced concrete.

Another popular type of reinforcement may be manufactured from tubular blanks with hot-rolled corrugated ribs. This manufacturing method provides a reduced weight of the reinforcement. However, such a tubular reinforcement structure typically cannot be made with a diameter less than 20 mm. Furthermore, the economic gain is insignificant, due to the increased complexity and energy consumption in the manufacturing of such reinforcement.

Another type of reinforcement is a cable reinforcement, which includes several metal wires wound into strands. This type of reinforcement structure provides a more effective reinforcement than the rebar, but has much higher cost of manufacture.

The main drawback of all these kinds of reinforcement is the ineffective use of the material: under combined loading of a reinforced concrete structure, such as under combined bending and tension, only the surface layers of the reinforcement are in fact working. The strength properties of the structure are not fully utilized.

In the past century, a substantial number of efforts have been made to develop spiral reinforcements whose structural quality coefficient (load-bearing capacity per mass) is substantially higher than that of the ribbed rebar currently being used.

One known rebar design is a steel band of rectangular cross-section twisted into a spiral, whose ribs after twisting are subjected to a deformation pattern. This technical solution also does not optimize the use of the material in the reinforcement structure.

Thus, there is a need for an improved reinforcement for reinforced concrete, which has lower weight while fully utilizing the strength properties of its material.

SUMMARY

Disclosed herein a reinforcement structure for reinforced concrete.

In one example aspect a reinforcement for reinforced concrete, comprises a spiral rod with a pitch of between 1 and 10 times a diameter of a cylinder into which the spiral rod is inscribed; wherein a planar cross-section of the rod includes: a central section around a central axis of the rod, and at least two petals connected to the central section and separated from each other by gaps; wherein, for at least two different concentric circles around the central axis of the rod, the sum of angle measures of cross-sections of the petals with the smaller circle is equal or less than the sum of angle measures of cross-sections of the petals with the greater circle.

In some aspects, the petals are substantially triangular in cross-section.

In some aspects, the petals are connected with the central section by their vertices.

In some aspects, the petal edges distant from the central section are circular.

In some aspects, the pitch is constant.

In some aspects, the pitch is variable.

In some aspects, at least one surface of the rod has ribs.

In some aspects, the ribs' height is between 0.5 mm and 1.0 mm and distances between the ribs are between 5 mm and 15 mm.

In some aspects, the bar is made of metal.

In some aspects, the bar is weldable.

The above simplified summary of example aspects of the invention serves to provide a basic understanding of the invention. This summary is not an extensive overview of all contemplated aspects, and is intended to neither identify key or critical elements of all aspects nor delineate the scope of any or all aspects of the invention. Its sole purpose is to present one or more aspects in a simplified form as a prelude to the more detailed description of the invention that follows. To the accomplishment of the foregoing, the one or more aspects of the present invention comprise the features described and particularly pointed out in the claims.

BRIEF DESCRIPTION OF THE DRAWINGS

The accompanying drawings, which are incorporated into and constitute a part of this specification, illustrate one or more example aspects of the invention and, together with the detailed description, serve to explain their principles and implementations.

DETAILED DESCRIPTION

Disclosed herein are example aspects of a reinforcement structure for reinforced concrete. Those of ordinary skill in the art will realize that the following description is illustrative only and is not intended to be in any way limiting. Other aspects will readily suggest themselves to those skilled in the art having the benefit of this disclosure. Reference will now be made in detail to implementations of the example aspects as illustrated in the accompanying drawings. The same reference indicators will be used throughout the drawings and the following description to refer to the same or like items.

Figure 1A:
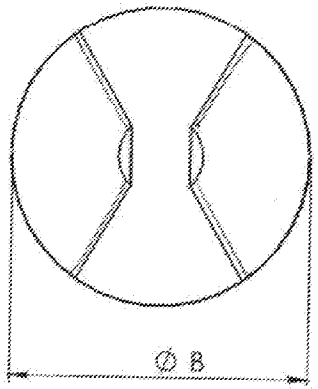
FIG. 1A illustrates a cross-section an example two-blade rebar with ribs on its surface.
Figure 1B:
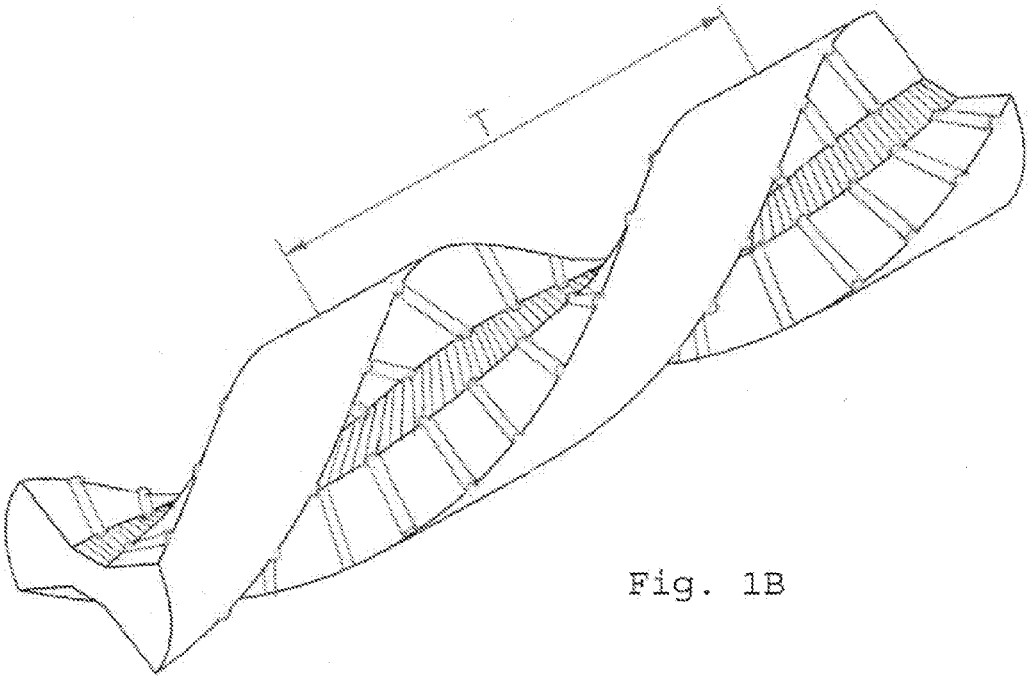
FIG. 1B illustrates a general view of an example two-blade rebar with ribs on its surface.
Figure 2A:
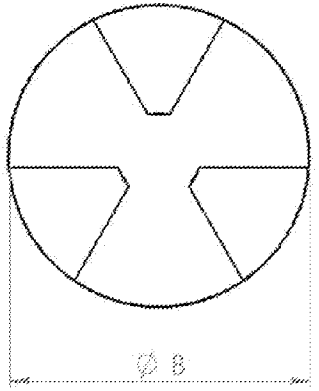
FIG. 2A illustrates a cross-section of an example three-blade rebar without ribs on its surface.
Figure 2B:
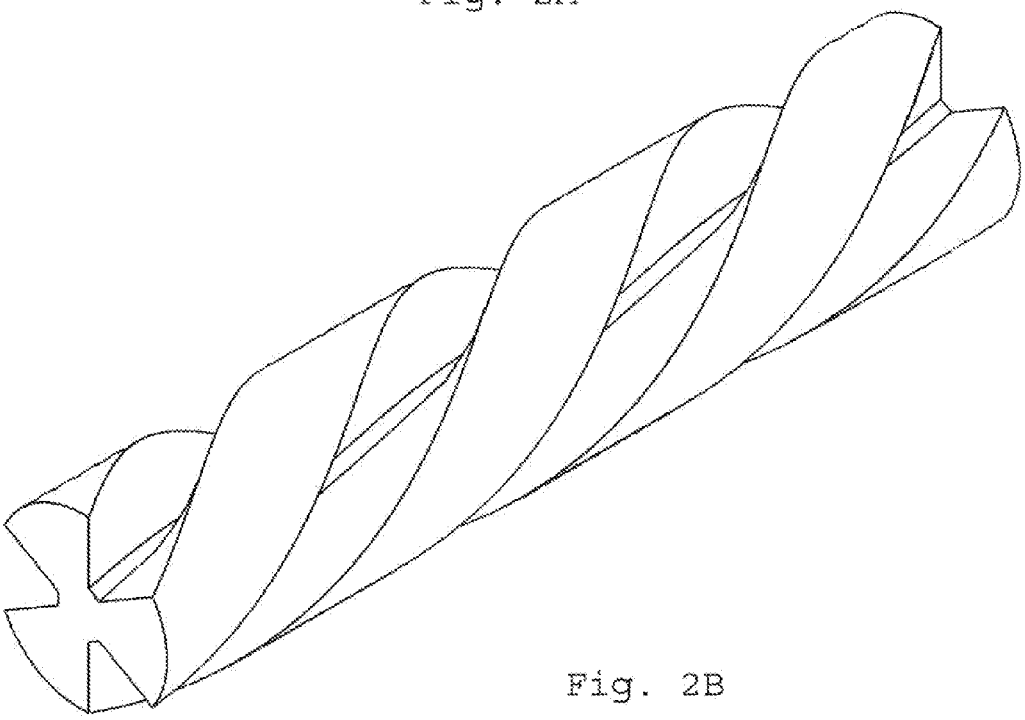
FIG. 2B illustrates a general view of an example three-blade rebar without ribs on its surface.
Figure 3A:
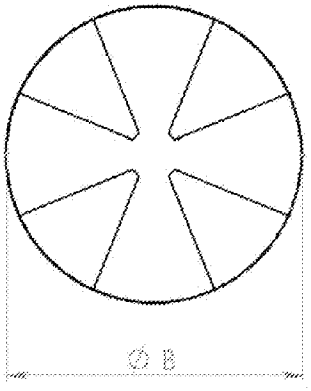
FIG. 3A illustrates a cross-section of an example four-blade rebar without ribs on its surface.
Figure 3B:
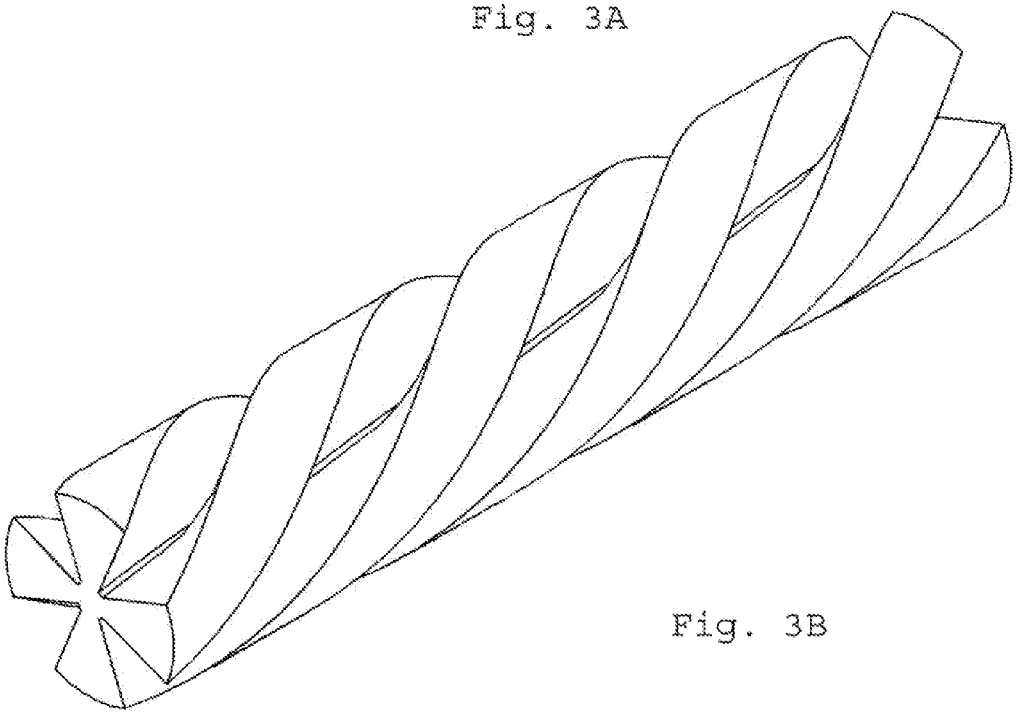
FIG. 3B illustrates a general view of an example four-blade rebar without ribs on its surface.

The example rebar shown in FIGS. 1-3 is a multi-blade spiral, with a pitch equal to 1 to 10 times the diameter of the imaginary cylinder (ØB) into which the spiral is inscribed. The blades spiral longitudinally along the length of the rod. The pitch T can be variable or constant. The cross section of each of the blades of the spiral is a generally triangular petal with its vertex pointing towards a central section around the axis of the reinforcement rod. The outward side of each of the triangular petals is shaped generally as an arc.

The example rebar may be made of metal, such as steel, and is weldable, which makes it useful for a broad range of applications.

The surfaces of the example blades of the spiral may have generally linear ribs or projections of linear shape, as shown, for example, in FIG. 1. The dimensions of the ribs' cross sections, depending on the diameter of the imaginary cylinder in which the spiral is inscribed, may be in the range of 0.5×0.5 to 1.0×1.0 mm, while the distance between them is in the range of 5 to 15 mm. The ribs may be shaped as a half-cylinder.

More generally the ribs may have arbitrary shape. In various aspects, the ribs may be straight, reticular or pointed. In various aspects, the ribs may be generally transverse or longitudinal in direction relative to the rod's axis.

One feature of the example rods is that their decreased weight (compared with a solid cylindrical rod) nevertheless substantially preserves the strength of the reinforced concrete structures made with such rods due to proper utilization of the strength properties of both the concrete and the reinforcement by transferring much of the reinforcement material to the periphery of its cross-section. This increased working capability of the reinforcement by redistributing its material to the periphery of the cross section is explained by the following considerations.

Combined loading is a loading in which several internal force factors are acting at the same time upon the structure's cross-sections. Combined loading can be considered as a combination of simple types (axial tension, bending, and torsion), wherein only a single internal force factor arises in the cross-sections of the structural elements; a normal force N in the case of tension, a bending moment $M_x$ for pure bending, and a torque $M_x$ for torsion. These kinds of loads (axial tension, bending, and torsion) are simple loads.

Their basic relations are presented in the following table.

| Loads | Strength Conditions |
|---|---|
| Axial Tension | $\sigma_{max} = \frac{N_{max,\kappa}}{F} \leq [\sigma]$ |
| Bending | $\sigma_{max} = \frac{M_{\imath max}}{W_x} \leq [\sigma]$ |
| Torsion | $\tau_{max} = \frac{M_{\kappa max}}{W_x} \leq [\tau]$ |

Here:

σ—axial tension strength

F—cross-sectional area

τ—shear strength $W_x$—axial moment of resistance, which is the ratio of the moment of inertia $J_x$ with respect to the axis and the distance to the most distant point of the cross section $r_{max}$ $J_x$—axial moment of inertia relative to an immovable axis, which is the sum of the products of the masses of all n material points of the system times the squares of their distances to the axis: $J_o=\Sigma m_i r_i^2$, where: i=1 . . . n, $m_i$ is the mass of the i-th point, $r_l$ is the distance from the i-th point to the axis.

As can be seen from the above formulas, the entire cross section of the example rod is loaded uniformly only under pure tension. Under combined loading, most of load is carried by the peripheral portions of the rebar's cross-section proportionally to the squares of their distances to the axis. For this reason, the cross section of the blades has a petal shape approximating a triangle for full utilization of its properties.

The use of the reinforcement of the present invention allows the preservation of the strength of reinforced concrete structures with substantially less weight of the rebar.

One advantage of the example rebar is a reduction in the overall mass of the reinforcement while preserving firmness of the reinforced concrete, which attributed to a fuller utilization of the firmness of both the concrete and reinforcement.

For example, the example rebar structure has substantially smaller mass than rebar-type reinforcement with equal resistance of the reinforced concrete structure to bending.

Another advantage of the example rebar structure is that is provides a significant increase in the contact surface between the reinforcement structure and the surrounding concrete material and, consequently, an increase in the load that the reinforced concrete can withstand with help of the reinforcement structure without failing.

An advantage of having ribs on the surface of the example rebar structure is that they prevent an "unscrewing" of the reinforcement structure from concrete under load.

An advantage of rounding of the edges of the example rebar structure is that it prevents concentration of stress in concrete at the point of contact with the reinforcement.

It should be also noted that a reinforced concrete that incorporates the example rebar structure has the same strength as a reinforced concrete that incorporates a rebar-type reinforcement having equal cross-section diameter.

Notably, the example rebar of such a design uses substantial less metal or steel while providing the same strength in comparison to the rebar-type reinforcement.

In the event of failure of building elements, such as during an earthquake, the use of example rebar reduces the risk of death or injury of people from collapsing pieces of concrete.

In various aspects, the process of manufacturing the example rebar structure described herein can be performed using known electro-mechanical rolling and twisting devices operated under the control of a computer programmed with specific program instructions. The example rebar can be fabricated, for example, by passing a heated cylindrical rod through one or more stands with two or more driven shaping rollers with textured working surface and subsequent twisting of the resulting rebar.

In the interest of clarity, not all of the routine features of the aspects are disclosed herein. It will be appreciated that in the development of any actual implementation of the invention, numerous implementation-specific decisions must be made in order to achieve the developer's specific goals, and that these specific goals will vary for different implementations and different developers. It will be appreciated that such a development effort might be complex and time-consuming, but would nevertheless be a routine undertaking of engineering for those of ordinary skill in the art having the benefit of this disclosure.

Furthermore, it is to be understood that the phraseology or terminology used herein is for the purpose of description and not of restriction, such that the terminology or phraseology of the present specification is to be interpreted by the skilled in the art in light of the teachings and guidance presented herein, in combination with the knowledge of the skilled in the relevant art(s). Moreover, it is not intended for any term in the specification or claims to be ascribed an uncommon or special meaning unless explicitly set forth as such.

The various aspects disclosed herein encompass present and future known equivalents to the known components referred to herein by way of illustration. Moreover, while aspects and applications have been shown and described, it would be apparent to those skilled in the art having the benefit of this disclosure that many more modifications than mentioned above are possible without departing from the inventive concepts disclosed herein.

The invention claimed is:

1. A reinforcement for reinforced concrete, comprising a spiral rod with a pitch of between 1 and 10 times a diameter of a cylinder into which the spiral rod is inscribed;

wherein a planar cross-section of the rod includes:

a central section around a central axis of the rod, and at least two petals connected to the central section and separated from each other by gaps;

wherein, for at least two different concentric circles around the central axis of the rod, a sum of angle measures of cross-sections of the petals with a smaller circle is equal or less than a sum of angle measures of cross-sections of the petals with a greater circle;

wherein a cross-sectional area of the central section is smaller than a cross-sectional area of at least one of the petals;

wherein at least one gap-facing petal surface of at least one gap of the rod has ribs facing the at least one gap;

wherein a maximum radial depth of the at least one gap is greater than a maximum height from the gap-facing petal surface of the ribs facing the at least one gap; and wherein the entire outside surface formed by at least one petal of the rod is a smooth helical continuous ribbon.

2. The reinforcement of claim 1, wherein the petals are substantially triangular in cross-section.

3. The reinforcement of claim 2, wherein the petals are connected with the central section by their vertices.

4. The reinforcement of claim 1, wherein petal edges distant from the central section are circular.

5. The reinforcement of claim 1, wherein the pitch is constant.

6. The reinforcement of claim 1, wherein the pitch is variable.

7. The reinforcement of claim 1, wherein the ribs' height is between 0.5 mm and 1.0 mm and distances between the ribs are between 5 mm and 15 mm.

8. The reinforcement of claim 1, wherein the bar is made of metal.

9. The reinforcement of claim 1, wherein the bar is weldable.

10. The reinforcement of claim 1, wherein the central section has ribs.

* * * * *